US012751494B2

(12) United States Patent
Batista et al.

(10) Patent No.: US 12,751,494 B2
(45) Date of Patent: Oct. 6, 2026

(54) TEMPERATURE DETECTION IN PERIPHERALLY HEATED AEROSOL-GENERATING DEVICE

(71) Applicant: Philip Morris Products S.A., Neuchatel (CH)

(72) Inventors: Rui Nuno Batista, Neuchatel (CH); Ricardo Cali, Mannheim (DE)

(73) Assignee: Philip Morris Products S.A., Neuchatel (CH)

( * ) Notice: Subject to any disclaimer, the term of this patent is extended or adjusted under 35 U.S.C. 154(b) by 544 days.

(21) Appl. No.: 17/636,214

(22) PCT Filed: Aug. 20, 2020

(86) PCT No.: PCT/EP2020/073307
§ 371 (c)(1),
(2) Date: Feb. 17, 2022

(87) PCT Pub. No.: WO2021/037655
PCT Pub. Date: Mar. 4, 2021

(65) Prior Publication Data

US 2022/0287376 A1 Sep. 15, 2022

(30) Foreign Application Priority Data

Aug. 23, 2019 (EP) ..... 19193439

(51) Int. Cl.
*A24F 40/51* (2020.01)
*A24F 40/42* (2020.01)
*A24F 40/465* (2020.01)

(52) U.S. Cl.
CPC ..... *A24F 40/51* (2020.01); *A24F 40/42* (2020.01); *A24F 40/465* (2020.01)

(58) Field of Classification Search
None
See application file for complete search history.

(56) References Cited

U.S. PATENT DOCUMENTS

2017/0119047 A1 5/2017 Blandino et al.
2017/0156403 A1 6/2017 Gill et al.
(Continued)

FOREIGN PATENT DOCUMENTS

EP 3 506 721 A1 7/2019
GB 2527597 A 12/2015
(Continued)

OTHER PUBLICATIONS

Rosemount Multipoint Thermocouple and RTD Profiling Sensors. Emerson, 2016, https://www.emerson.com/documents/automation/product-data-sheet-rosemount-multipoint-thermocouple-rtd-profiling-sensors-type-tx-mtx-wx-mwx-en-88382.pdf. (Year: 2016).*
(Continued)

*Primary Examiner* — Philip Y Louie
*Assistant Examiner* — Nicole A Szumigalski
(74) *Attorney, Agent, or Firm* — Oblon, McClelland, Maier & Neustadt, L.L.P.

(57) ABSTRACT

An aerosol-generating device is provided, including: a cavity configured to receive an aerosol-forming substrate; an external heating element of the aerosol-generating device configured to exclusively externally heat the aerosol-forming substrate when the aerosol-forming substrate is received in the cavity; and an elongate temperature sensor provided in the cavity and being configured to penetrate the aerosol-forming substrate when the aerosol-forming substrate is received in the cavity. An aerosol-generating system, and a method of generating an inhalable aerosol in an aerosol-generating device, are also provided.

13 Claims, 6 Drawing Sheets

(56) References Cited

U.S. PATENT DOCUMENTS

| | | | | |
|---|---|---|---|---|
| 2018/0029782 | A1* | 2/2018 | Zuber | A24F 40/42 |
| 2018/0049472 | A1 | 2/2018 | Mahler et al. | |
| 2018/0317553 | A1 | 11/2018 | Blandino et al. | |
| 2019/0142068 | A1 | 5/2019 | Gill et al. | |
| 2019/0230987 | A1* | 8/2019 | Wu | H05B 6/36 |
| 2020/0015525 | A1 | 1/2020 | Gill et al. | |
| 2020/0060348 | A1 | 2/2020 | Mironov et al. | |
| 2020/0367562 | A1* | 11/2020 | Liu | H05B 3/06 |
| 2023/0354884 | A1* | 11/2023 | Jeong | A24F 40/30 |

FOREIGN PATENT DOCUMENTS

| | | | | |
|---|---|---|---|---|
| JP | 2019-509727 | A | 4/2019 | |
| JP | 2019-129820 | A | 8/2019 | |
| KZ | 33793 | B | 7/2019 | |
| RU | 2 605 837 | C2 | 12/2016 | |
| RU | 2 606 711 | C1 | 1/2017 | |
| RU | 2 613 785 | C2 | 3/2017 | |
| RU | 2 682 351 | C1 | 3/2019 | |
| WO | WO2016/124550 | A1 | 8/2016 | |
| WO | WO 2017/072149 | A1 | 5/2017 | |
| WO | WO2018/206616 | A1 | 11/2018 | |
| WO | WO 2018/220558 | A1 | 12/2018 | |
| WO | WO-2019021119 | A1 * | 1/2019 | |
| WO | WO-2019115464 | A1 * | 6/2019 | A24F 40/57 |
| WO | WO-2019121811 | A1 * | 6/2019 | A24F 40/20 |
| WO | WO 2019/129844 | A1 | 7/2019 | |
| WO | WO-2020153830 | A1 * | 7/2020 | A24F 40/50 |

OTHER PUBLICATIONS

Combined Chinese Office Action and Search Report issued Dec. 4, 2023, in corresponding Chinese Patent Application No. 202080054711.0 (with English Translation), 13 pages.

International Search Report and Written Opinion issued on Nov. 10, 2020 in PCT/EP2020/073307 filed on Aug. 20, 2020.

Japanese Notice of Reasons for Refusal issued Jul. 3, 2023 in Japanese Application No. 2022-509659, (with English translation), 3 pages.

Combined Russian Office Action and Search Report issued Aug. 23, 2022 in Russian Patent Application No. 2022104355/03 (with unedited computer generated English Translation), 16 pages.

Japanese Office Action issued on Mar. 15, 2023 in Japanese Patent Application No. 2022-509659 (with English translation), 9 pages.

* cited by examiner

TEMPERATURE DETECTION IN PERIPHERALLY HEATED AEROSOL-GENERATING DEVICE

The present invention relates to an aerosol-generating device in which an inhalable aerosol is formed by external heating of an aerosol-forming substrate and in which the temperature of the aerosol-forming substrate is detected by a separate temperature sensor that is provided inside the aerosol-forming substrate. The present invention further relates to an aerosol-generating system comprising the aerosol-generating device and an aerosol-generating article. The invention further relates to a method for generating an inhalable aerosol.

Aerosol-generating devices are known which heat but which do not burn aerosol-forming substrates such as tobacco. Such devices heat aerosol-forming substrates to a sufficiently high temperature for generating an inhalable aerosol.

Known aerosol-generating devices typically comprise a heating element and a heating chamber. An aerosol-generating article comprising an aerosol-forming substrate may be inserted into the heating chamber and heated by the heating element. These aerosol-generating devices may not have means to directly measure the real temperature inside the portion of the aerosol-generating article that produces the aerosol while the device is in use. Instead, the temperature of the heating element is measured and the internal temperature of the aerosol-forming substrate is extrapolated based on this temperature reading. The estimated temperature may deviate from the actual temperature of the aerosol-forming substrate.

It is an object of the present invention to provide an aerosol-generating device that allows for direct measurement of the temperature of the aerosol-forming substrate in use. This object is achieved by the present invention in that the aerosol-generating device comprises a cavity for receiving an aerosol-forming substrate. The device further comprises an external heating element with which the aerosol-forming substrate is heated. An elongate temperature sensor is provided in the cavity of the aerosol-generating device. The elongate temperature sensor is configured to penetrate the aerosol-forming substrate when said aerosol-forming substrate is received in the cavity.

In use of the aerosol-generating device, the aerosol-forming substrate is inserted into the cavity of the aerosol-generating device. Preferably, in use of the aerosol-generating device, the aerosol-forming substrate is fully inserted into the cavity of the aerosol-generating device such that the aerosol-forming substrate abuts the closed end of the cavity.

In use of the aerosol-generating device, the elongate temperature sensor is inserted into the aerosol-forming substrate.

The elongate temperature sensor may be provided in the cavity of the aerosol-generating device as a separate element. In particular, the elongate heating element may be provided separately from the external heating element. In this way the elongate temperature sensor allows for direct measurement of the substrate temperature. The temperature determined by the elongate temperature sensor corresponds to the actual temperature of the aerosol-forming substrate which is surrounding the elongate temperature sensor. It is not required to make any estimation or extrapolation in order to determine the temperature of the surrounding aerosol-forming substrate.

The cavity of the aerosol-generating device may be a cylindrical recess extending from the periphery of the aerosol-generating device. In other words, the cavity of the aerosol-generating device may be a cylindrical recess extending from the mouth end of the device into the device. The cavity of the aerosol-generating device may have an open end into which an aerosol-generating article is inserted. The cavity may have a closed end opposite the open end. The closed end may be the base surface of the cavity. The closed end may be closed except for the provision of air apertures arranged in the base. The base of the cavity may be flat. The base of the cavity may be circular. The base of the cavity may be arranged upstream of the open end of the cavity. The open end may be arranged downstream of the closed end of the cavity. The longitudinal direction may be the direction extending between the open and closed ends. The longitudinal axis of the cavity may be parallel with the longitudinal axis of the aerosol-generating device.

The cavity may be configured as a heating chamber. The cavity may have a cylindrical shape. The cavity may have a hollow cylindrical shape. The cavity may have a circular cross-section. The cavity may have an elliptical or rectangular cross-section. The cavity may have a diameter corresponding to the diameter of the aerosol-generating article.

As used herein, the term 'proximal' refers to a user end or mouth end of the aerosol-generating device, and the term 'distal' refers to the end opposite to the proximal end. When referring to the cavity, the term 'proximal' refers to the region closest to the open end of the cavity and the term 'distal' refers to the region closest to the closed end.

As used herein, the terms 'upstream' and 'downstream' are used to describe the relative positions of components, or portions of components of the aerosol-generating device in relation to the direction in which a user draws on the aerosol-generating device during use thereof.

As used herein, the term 'aerosol-forming substrate' relates to a substrate capable of releasing volatile compounds that can form an aerosol. Such volatile compounds may be released by heating the aerosol-forming substrate. An aerosol-forming substrate is part of an aerosol-generating article.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick. The aerosol-generating article may be insertable into the cavity of the aerosol-generating device.

As used herein, the term 'aerosol-generating device' refers to a device that interacts with an aerosol-generating article to generate an aerosol.

As used herein, the term 'aerosol-generating system' refers to the combination of an aerosol-generating article, as further described and illustrated herein, with an aerosol-generating device, as further described and illustrated herein. In the system, the aerosol-generating article and the aerosol-generating device cooperate to generate a respirable aerosol.

The elongate temperature sensor may be mounted to the base surface of the cavity. The elongate temperature sensor may be mounted to the base surface of the cavity via a conical mounting element extending from the base surface. The elongate temperature sensor may extend from the base surface into the inner volume of the cavity. The elongate temperature sensor may extend parallel to the central longitudinal axis of the cavity. The elongate temperature sensor may extend centrally in the cavity. When an aerosol-generating article is fully inserted into the cavity of the aerosol-generating device, the elongated temperature sensor is located in the aerosol-forming substrate of the aerosol-generating article.

The elongate temperature sensor may extend along the full length of the cavity. The elongate temperature sensor may extend along a part of the length of the cavity. The elongate temperature sensor may extend along about half the length of the cavity.

The elongate temperature sensor may have any desired cross section. The elongate temperature sensor may be generally of cylindrical shape. The elongate temperature sensor may have a radius smaller than 1 millimeter, may have a radius ranging between 0.1 to 0.5 millimeters, or may have a radius ranging between 0.2 to 0.4 millimeters. The elongate temperature sensor may have a tapered end, with the tapered end pointing towards the opening of the cavity. The elongate temperature sensor may be needle-shaped.

By providing the elongate temperature sensor with small cross sectional area, only very low compression of the aerosol-forming substrate occurs upon insertion of the aerosol-generating article into the cavity. This enables a smooth, repeatable and consistent insertion of the aerosol-generating article into the cavity. Such insertion requires minimum effort and is not or only hardly perceivable by the user.

In addition also the resistance-to-draw (RTD) of the aerosol-generating article is not or only minimally affected by inserting the temperature sensor into the aerosol-forming substrate of the aerosol-generating article. Accordingly, the present invention allows for a reproducible user experience.

The elongate temperature sensor may have tubular shape. The elongate temperature sensor may be solid or partially solid.

The temperature sensor may be made from or coated with ceramic, glass, PAEK (Polyaryletherketone), PEEK (Polyetheretherketone), PEEKK (Polyetheretherketonketone), PTFE (Polytetrafluoroethylene).

The temperature sensor may comprise a thermistor, a resistance temperature detector, a thermo-couple or an optical fibre microprobe.

The temperature sensor may comprise a single thermal sensing point located at any desired position along the temperature sensor. The temperature sensor may also comprise two, three, four or more thermal sensing points located at any desired positions along the temperature sensor. Each of the thermal sensing points may be located at a different position along the length of the temperature sensor.

By using a plurality of temperature sensing points and by distributing the sensor points over the length of the temperature sensor, more detailed information about the internal temperature regime of the aerosol-forming substrate is obtained.

The temperature sensor may be immune to or only little affected by electro-magnetic radiation, such as radio frequency and/or microwave radiation. Depending on the heating technique used in the aerosol-generating device, the cavity may be subjected to external electric, magnetic or electro-magnetic fields. These external fields may interfere with the temperature measurement of the temperature sensor. By choosing temperature sensors being made from appropriate material, negative impact of such external fields can be reduced or completely avoided. In particular optical fibre microprobes that are immune to external electro-magnetic radiation may be advantageously used in this regard.

Suitable optical fibre microprobes may employ an optical fibre. The measuring principle may be based on the well-known technology of optical time domain reflectometry (OTDR) or optical frequency domain reflectometry (OFDR). Some technologies also make use of semiconducting material having a temperature dependent band gap. Crystals made from such material may be located at the tip of the optical fibre. Typically semiconducting materials such as gallium arsenide (GaAs) are used as sensing crystal for such applications.

The heating element of the aerosol-generating device is an external heating element. The term 'external' refers to the location of the heating element with respect to the aerosol-forming substrate to be heated. An external heating element is a heating element that in use of the device and when the aerosol-generating article is inserted into the cavity of the aerosol-generating device is located external to the aerosol-forming substrate. The external heating element may comprise an electrically resistive material. The heating element may be a resistive heating element or an inductive heating element.

The external heating element may take any suitable form. The heating element may be hollow. In some embodiments the heating element may be tube shaped. The heating element may define the cavity of the aerosol-generating device.

The external resistive heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

An inductive heating element may be configured to generate heat by means of induction. The inductive heating element may comprise an induction coil and a susceptor arrangement. The induction coil may be used to generate an alternating magnetic field. The induction coil may surround the susceptor arrangement. The inductive heating element may comprise a plurality of induction coils and a plurality of susceptor arrangements. Preferably, two induction coils are provided. If more than one susceptor arrangements are provided, preferably electrically insulating elements are provided between the susceptor arrangements.

As used herein, a 'susceptor arrangement' denotes a conductive element that heats up when subjected to the changing magnetic field generated by the induction coil. This may be the result of eddy currents induced in the susceptor arrangement, hysteresis losses, or both eddy currents and hysteresis losses. During use, the susceptor arrangement is located in thermal contact or close thermal proximity with the aerosol-forming substrate of an aerosol-generating article received in the cavity of the aerosol-generating device. In this manner, the aerosol-forming substrate is heated by the susceptor arrangement such that an aerosol is formed.

In some embodiments, the aerosol-generating device may be adapted to operate one or more induction coils of the inductive heating element at frequencies of an alternating current flowing through the induction coil ranging from about 1 Megahertz (MHz) to about 30 Megahertz (MHz), preferably from about 1 Megahertz (MHz) to about 10 MHz, and more preferably from about 5 Megahertz (MHz) to about 7 Megahertz (MHz).

The susceptor arrangement may have a cylindrical shape. The susceptor arrangement may have a tubular shape. The susceptor arrangement may be arranged surrounding the cavity. The susceptor arrangement may be positioned inside of the cavity. The susceptor arrangement may be arranged for holding the aerosol-generating article, when the aerosol-generating article is inserted into the cavity.

The susceptor arrangement may comprise one or more blade shaped susceptors. The blade shaped susceptors may have flared downstream ends to facilitate insertion of the aerosol-generating article into the blade shaped susceptors.

The susceptor arrangement may have a shape corresponding to the shape of the corresponding induction coil. The susceptor arrangement may have a diameter smaller than the diameter of the corresponding induction coil such that the susceptor arrangement can be arranged inside of the induction coil.

The susceptor arrangement may be formed from any material that can be inductively heated to a temperature sufficient to aerosolize an aerosol-forming substrate. Suitable materials for the susceptor arrangement include graphite, molybdenum, silicon carbide, stainless steels, niobium, aluminium, nickel, nickel containing compounds, titanium, and composites of metallic materials. Preferred susceptor arrangements comprise a metal or carbon. Advantageously the susceptor arrangement may comprise or consists of a ferromagnetic material, for example, ferritic iron, a ferromagnetic alloy, such as ferromagnetic steel or stainless steel, ferromagnetic particles, and ferrite. A suitable susceptor arrangement may be, or comprise, aluminium.

The cavity comprises a 'heating zone'. The heating zone is a portion of the length of the cavity which is at least partially surrounded by the induction coils so that the susceptor arrangement placed in or around the heating zone is inductively heatable by the induction coils. The heating zone may comprise a first heating zone and a second heating zone. The heating zone may be split into the first heating zone and the second heating zone. The first heating zone may be surrounded by a first induction coil. The second heating zone may be surrounded by a second induction coil. More than two heating zones may be provided. Multiple heating zones may be provided. An induction coil may be provided for each heating zone. One or more induction coils may be arranged moveable to surround the heating zones and configured for segmented heating of the heating zones.

The one or more induction coils are each disposed at least partially around the heating zone. An induction coil may extend only partially around the circumference of the cavity in the region of the heating zone. An induction coil may extend around the entire circumference of the cavity in the region of the heating zone.

The induction coil may be helical and concentric. The induction coil may be helical and wound around a central void in which the cavity is positioned. The induction coil may be disposed around the entire circumference of the cavity.

If two induction coils are used, the first and second induction coil may have different diameters. The first and second induction coil may be helical and concentric and may have different diameters. In such embodiments, the smaller of the two coils may be positioned at least partially within the larger of the first and second induction coil.

The windings of the first induction coil may be electrically insulated from the windings of the second induction coil.

The first and second induction coil may be formed from the same type of wire. The first induction coil may be formed from a first type of wire and the second induction coil may be formed from a second type of wire which is different to the first type of wire. For example, the wire compositions or cross-sections may differ. In this manner, the inductance of the first and second induction coil may be different even if the overall coil geometries are the same. This may allow the same or similar coil geometries to be used for the first and second induction coil. This may facilitate a more compact arrangement of the aerosol-generating device.

Suitable materials for the induction coil include copper, aluminium, silver and steel. The induction coil may be formed from a wire of such materials. The induction coil may be formed from a wire of copper or aluminium.

If two induction coils are used, the first coil may comprise a first wire material and the second coil may comprise a second wire material which is different from the first wire material. The electrical properties of the first and second wire material may differ. For example, first type of wire may have a first resistivity and the second type of wire may have a second resistivity which is different to the first resistivity.

The aerosol-generating device may comprise a flux concentrator. The flux concentrator may be made from a material having a high magnetic permeability. The flux concentrator may be arranged surrounding the induction heating arrangement. The flux concentrator may concentrate the magnetic field lines to the interior of the flux concentrator thereby increasing the heating effect of the susceptor arrangement by means of the induction coil.

The external heating element advantageously heats the aerosol-forming substrate by means of conduction. The heating element may be at least partially in contact with the substrate or the carrier on which the substrate is deposited. Alternatively, the heat from either an internal or external heating element may be conducted to the substrate by means of a heat conductive element.

During operation, the aerosol-forming substrate may be completely contained within the aerosol-generating device. In that case, a user may puff on a mouthpiece of the aerosol-generating device. Alternatively, during operation a smoking article containing the aerosol-forming substrate may be partially contained within the aerosol-generating device. In that case, the user may puff directly on the smoking article.

The aerosol-generating device may comprise a protection mechanism for protecting the elongate temperature sensor in the cavity. The protection mechanism may assist in stabilization of the elongate temperature sensor upon insertion of the aerosol-generating article into the cavity of the aerosol-generating device. The protection mechanism may also protect the elongate temperature sensor from external influence between user experiences that is when no aerosol-generating article is inserted into the cavity.

The protection mechanism may comprise a moveable piston that is arranged inside the cavity between the cavity walls and the temperature sensor. The moveable piston may have a generally cylindrical design. The cross section of the moveable piston may correspond to the cross section of the cavity of the aerosol-generating device. The cross section of the moveable piston may be slightly smaller than the cross section of the cavity of the aerosol-generating device, such that the piston is linearly moveable within and along the longitudinal axis of the cavity.

The moveable piston may be configured with a rotational symmetric design. The moveable piston may be provided with an opening for allowing the temperature sensor to pass through. The opening may be provided centrally in the moveable piston.

The moveable piston may be arranged such that it is moveable between a first and a second position within the cavity. In the first position the movable piston is located in such way in the cavity that the end face of piston covers the front end of the elongate temperature sensor. In the second position the movable piston is located in close proximity to the base surface of the cavity, such that the elongate temperature sensor extends through the opening. In use, the moveable piston is in the second position.

The piston is configured to assume the first position when no aerosol-generating article is inserted. The piston is configured to assume the second position when an aerosol-generating article is inserted into the cavity.

The protection mechanism may comprise a compression spring located between the base surface and the moveable piston. The compression spring ensures that the moveable piston is urged into the first position, when no aerosol-generating article is inserted into the cavity.

The compression spring may have a spring constant that is sufficiently high to bias the moveable piston into the first position, when no aerosol-generating article is inserted into the cavity. At the same time, the compression spring may have a spring constant that is sufficiently low, so that upon insertion of an aerosol-generating article into the cavity, the compression spring is contracted and the movable piston is urged into the second position.

The compression spring may have a spring constant of below 2 Newtons per meter. The compression spring may have a spring constant of below 1 Newton per meter. The compression spring may have a spring constant between of 0.01 to 0.5 Newtons per meter.

The compression spring may be made from any suitable material. In particular, when an inductive heating element is used, it may be advantageous to manufacture the compression spring from non-susceptive material, such as stainless steel or polymeric composite materials. For example stainless steel 302/304 or 316 or a thermoplastic polyetherimide (PEI) resin may be used. These stainless steel materials may be non-magnetic or only slightly magnetic, and do therefore not or only slightly interact with the magnetic field generated by the induction coil.

In some embodiments of the invention, the moveable piston may have a double cylindrical design comprising an outer and an inner cylindrical wall. The outer cylindrical sidewall defines the outer shape of the piston and contacts the inner wall of the cavity. The inner cylindrical sidewall defines a channel through which the elongate temperature sensor is guided upon movement of the moveable piston within the cavity. The compression spring may be located in between the inner and outer sidewalls of the moveable piston. In this configuration the compression spring is housed within the piston and is guided by the cylindrical sidewalls of the piston. This ensures reliable and reproducible operation of the piston.

The inner cylindrical sidewall of the moveable piston may have a conical shape that corresponds to the conical shape of the conical mounting element extending from the base surface of the cavity. The conical shape may assist in maintaining the piston in a central and well defined orientation. This further ensures reliable operation and movement of the piston.

The inner wall of the cavity may be provided with suitable stop elements in order to limit the axial outward movement of the moveable piston. Such stop elements may be protrusions or similar means that engage with the outer wall of the piston.

The piston may be used to protect the thin elongate temperature sensor. The piston may further be used to stabilize the free end of the elongate temperature sensor upon insertion of the aerosol-generating article. In particular, the piston may help to prevent lateral mechanical forces on the elongate temperature sensor upon insertion of the aerosol-generating article into the cavity of the aerosol-generating device.

Air may flow into the cavity through an air aperture in the base of the cavity. The air may subsequently enter into the aerosol-generating article at the upstream end face of the aerosol-generating article. Alternatively or additionally, air may flow between the side wall of the cavity, preferably formed by the thermally insulating element, and the blade shaped susceptor elements. The air may then enter into the aerosol-generating article through gaps between the blade shaped susceptor elements. A uniform penetration of the aerosol-generating article with air may be achieved in this way, thereby optimizing aerosol generation.

The aerosol-generating device further comprises air inlets that allow ambient air to enter into the cavity. In use of the device the air is guided through the aerosol-generating article that is inserted into the cavity.

The moveable piston may comprise air holes that establish an air flow path and that allow the air to enter into the open end of the aerosol-generating article. Such air holes may be comprised in the base or in the sidewalls or in both the base and the sidewall of the piston. In this way the piston may be used to design the air flow path in any desired way.

The heating element of the aerosol-generating device may comprise perforations for allowing air to enter the cavity. Such perforations may be present along the full length of the cavity or only in certain parts of the heating element. Perforations may be provided in the vicinity of the base surface of the cavity. In this way also the heating element may be used to define and design the air flow path of the aerosol-generating device.

The opening at the end face of the moveable piston may be provided with a wiping element. The wiping element may be configured to clean off any debris sticking to the elongate temperature sensor when the moveable piston is moved along the longitudinal axis of the cavity. The wiping element may comprise a membrane of elastic polymeric material that is arranged at the opening of the moveable piston. When the piston linearly moves along the temperature sensor, the membrane of polymeric material is configured to scrape off any debris or residues sticking to the surface of the temperature sensor. A clean surface of the temperature sensor may be required to perform a precise and reliable temperature measurement. Similar membranes may also be provided to the outer circumferential surface of the upper end face of the piston and may be used to clean off debris from the inner sidewall of the cavity.

The present invention is also related to an aerosol-generating system comprising an aerosol-generating device as described above and an aerosol-generating article. In use of the aerosol-generating system, the aerosol-generating article is inserted into the cavity of the aerosol-generating device. However, the aerosol-generating system may include additional components, such as, for example a charging unit for recharging an on-board electric power supply in an electrically operated or electric aerosol-generating device.

In any of the above embodiments, the aerosol-generating article and the cavity of the aerosol-generating device may be arranged such that the aerosol-generating article is partially received within the cavity of the aerosol-generating device. The cavity of the aerosol-generating device and the aerosol-generating article may be arranged such that the aerosol-generating article is entirely received within the cavity of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 mm. Alternatively, the aerosol-forming segment may have a length of approximately 12 millimetres.

The aerosol-generating segment may have an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug may be a hollow cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

The present invention also relates to a method of generating an inhalable aerosol in an aerosol-generating device. The method comprises the steps of providing an aerosol-generating device with a cavity for receiving an aerosol-forming substrate, providing an external heating element, and providing an elongate temperature sensor in the cavity. In use of the aerosol-generating device the aerosol-forming substrate is inserted into the cavity. The method further comprises determining the temperature of the aerosol-forming substrate by means of the elongate temperature sensor that is located in direct contact with the aerosol-forming substrate.

In the method of the present invention the elongate temperature sensor may comprise a thermal sensing point, such as a thermo-couple or an optical fibre microprobe.

The elongate temperature sensor may comprise one, two, three or more thermal sensing points located at different positions along the length of the temperature sensor.

The elongate temperature sensor is tubular, solid or partially solid.

In the method of the present invention, the heating element may define the cavity of the aerosol-generating device.

In the method of the present invention, the heating element may be an inductive heating element, comprising an induction coil and a susceptor arrangement.

In the method of the present invention, the inductive heating element used in the method of the present invention may comprise two induction coils.

The one or more induction coils may be provided such that they are located radially outward from the susceptor arrangement.

The method may further comprise providing a protection mechanism for protecting the elongate temperature sensor in the cavity.

The protection mechanism may comprise a moveable piston that is arranged inside the cavity between the cavity walls and the temperature sensor.

The protection mechanism may further comprise a compression spring, which is configured to bias the moveable piston in a position in which the moveable piston at least partly covers the elongate temperature sensor, when no aerosol-forming substrate is inserted into the cavity. Preferably, the compression spring is configured to bias the moveable piston in a position in which the moveable piston at least partly covers the elongate temperature sensor, when no aerosol-forming substrate is fully inserted into the cavity.

In the method of the present invention, the moveable piston may be provided with a central opening through which the elongate temperature sensor extends.

Features described in relation to one embodiment may equally be applied to other embodiments of the invention.

The invention will be further described, by way of example only, with reference to the accompanying drawings in which.

Figure 1:
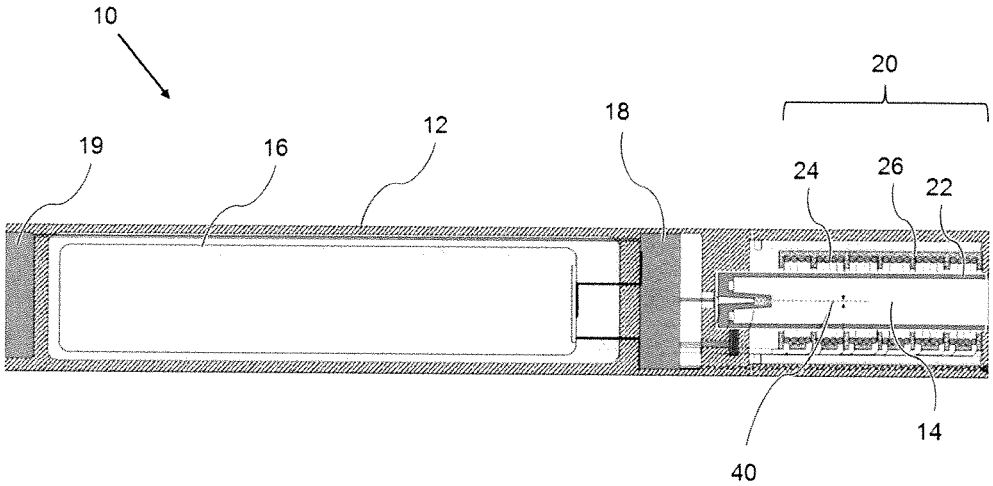
FIG. 1 shows an embodiment of the present invention.

An embodiment of an aerosol-generating device 10 of the present invention is depicted in FIG. 1. The aerosol-generating device 10 comprises a substantially cylindrical device housing 12, with a shape and size similar to a conventional cigarette. The device housing 12 defines a device cavity 14 at a proximal end of the aerosol-generating device 10. The cavity 14 is substantially cylindrical, open at a proximal end, and substantially closed at a distal end, opposite the proximal end. The cavity 14 is configured to receive an aerosol-generating segment of an aerosol-generating article.

Within the cavity 14 there is provided an elongate temperature sensor 40. When an aerosol-generating article is inserted into the cavity, the elongate temperature sensor 40 is located in direct contact with aerosol-forming substrate of the aerosol-generating article. The elongate temperature sensor 40 allows for direct measurement of the actual temperature of the aerosol-forming substrate.

The aerosol-generating device 10 further comprises a power supply 16, in the form of a rechargeable nickel-cadmium battery, a controller 18 in the form of a printed circuit board including a microprocessor, an electrical connection port 19, and an inductive heating element 20. The power supply 16, controller 18 and inductive heating element 20 are all housed within the device housing 12. The inductive heating element 20 of the aerosol-generating device 10 is arranged at the proximal end of the device 10, and is generally disposed around the device cavity 14. The electrical connection port 19 is arranged at a distal end of the device housing 12, opposite the device cavity 14.

The controller 18 is configured to control the supply of power from the power supply 16 to the inductive heating element 20. The controller 18 further comprises a DC/AC inverter and is configured to supply a varying or alternating current to the inductive heating arrangement 20. The controller 18 is also configured to control recharging of the power supply 16 by an external power source connectable to electrical connection port 19. In addition, the controller 18 comprises a puff sensor (not shown) configured to sense when a user is drawing on an aerosol-generating article received in the device cavity 14.

Figure 2:
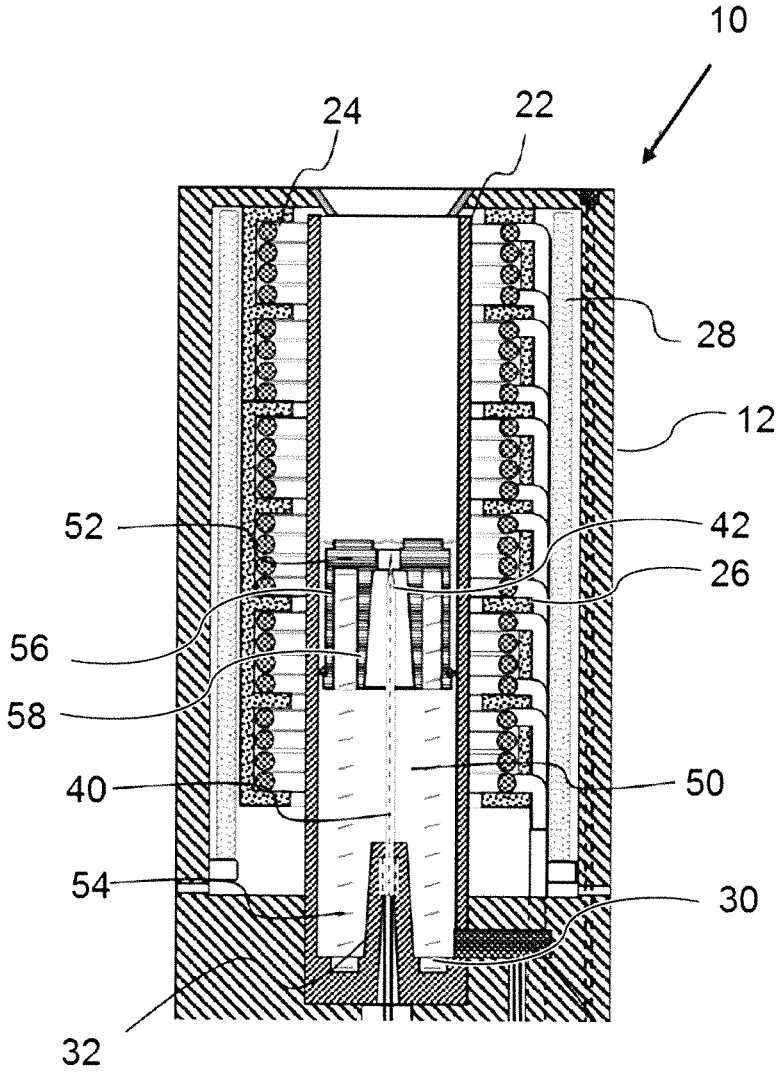
FIG. 2 shows an enlarged view of the embodiment of FIG. 1.

FIG. 2 is an enlarged view of the proximal end of the aerosol-generating device showing in more detail the cavity 14 and the inductive heating element 20.

The inductive heating element 20 comprises a susceptor arrangement 22. The susceptor arrangement 22 is a single tubular susceptor element. This single tubular susceptor element defines the recess in which the aerosol-generating article is received.

The inductive heating element 20 further comprises six inductive coils 24 arranged around the tubular susceptor element. Between the inductive coils 24, flux concentrators 26 are provided.

Between the housing 12 and the inductive heating element 20, a tubular thermal insulation element 28 is arranged. This thermal insulation element 28 is used for protecting the housing 12 from excessive heat.

The elongate temperature sensor 40 is provided centrally within the cavity 14. The elongate temperature sensor 40 is mounted to the base surface 30 of the cavity 14 by means of a conical connection element 32. The elongate temperature sensor 40 is a thin needle-shaped element having a diameter of 1 millimeter. The shape of the elongate temperature sensor 40 is such that the additional force needed to insert the temperature sensor 40 into the aerosol-forming substrate of the aerosol-generating article is not perceivable to the user.

However, the elongate temperature sensor 40 is also prone to deformation during insertion and retraction of the aerosol-generating article from the cavity 14. In order to avoid such deformation, a protection mechanism 50 is provided in the cavity 14. This protection mechanism 50 comprises a movable piston 52 and a compression spring 54. The movable piston 52 protects and stabilizes the free end 42 of the elongate temperature sensor upon insertion of an aerosol-generating article.

The movable piston 52 generally is of cylindrical shape. It has a double cylindrical design comprising an outer cylindrical sidewall 56 and an inner cylindrical sidewall 58. The outer cylindrical sidewall 56 defines the outer shape of the piston 52 and contacts the inner sidewall of the tubular susceptor element 22. The inner cylindrical sidewall 58 defines a channel through which the elongate temperature sensor 40 is guided upon movement of the moveable piston 52 within the cavity 14.

The moveable piston further comprises a central opening 60 for allowing the temperature sensor to pass through. The central opening 60 is provided in the proximal end face 62 of the moveable piston 52.

Compression spring 54 is arranged such that its proximal end is located in between the inner and outer sidewalls 56, 58 of the moveable piston 52. The distal end of compression spring 54 is provided adjacent to the base surface of the cavity.

Figure 3:
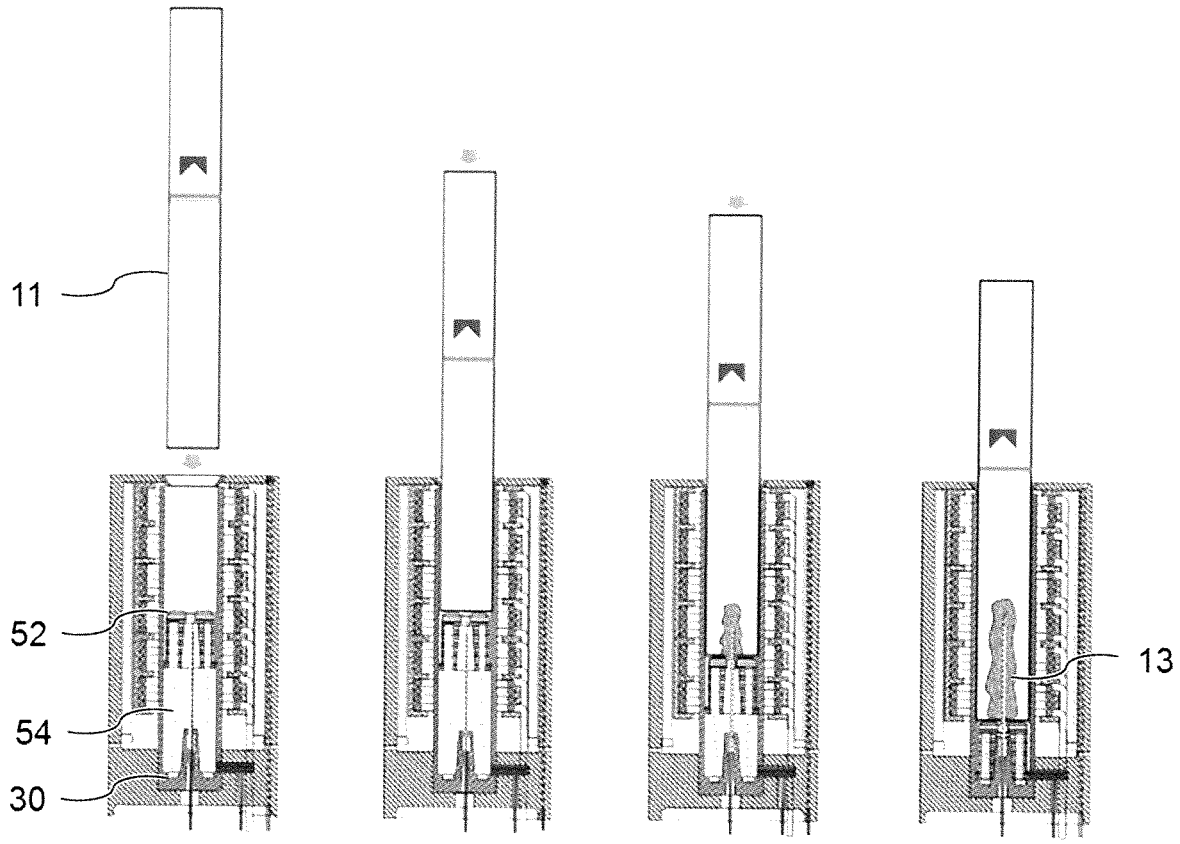
FIG. 3 shows the process of inserting an aerosol-generating article.

As depicted in FIG. 3 the moveable piston may be arranged such that it is moveable between a first position (left view of FIG. 3) and a second position (right view of FIG. 3) within the cavity 14.

The piston is configured to assume the first position when no aerosol-generating article 11 is inserted into the cavity. In the first position the movable piston 52 is located in such way in the cavity 14 that the distal end face 62 of the moveable piston 52 covers the free end 42 of the elongate temperature sensor 40. Compression spring 54 ensures that the moveable piston is urged into the first position, when no aerosol-generating article 11 is inserted into the cavity 14. A stopper element (not shown) is provided in the cavity 14 to limit the outward longitudinal movement of the movable piston 52.

Upon insertion of an aerosol-generating article 11 into the cavity 14, the distal end of the aerosol-generating article 11 engages with the movable piston 52 and pushes the movable piston 52 towards the base surface 30 of the cavity 14. During this process the movable piston 52 supports the free end 42 of the elongate temperature sensor 40. As can be seen in the two partly cut-away views at the right of FIG. 3, the movable piston 52 ensures that the temperature sensor 40 is maintained in a central position within the aerosol-forming substrate 13 of the aerosol-generating article 11.

The compression spring 54 is made from thermoplastic polyetherimide (PEI) resin, which is a non-susceptive material and which does not interact with the magnetic field generated by the induction coils 24. The spring force of the compression spring 54 is sufficiently low, such that the friction force between the aerosol-generating article 11 and the tubular susceptor element maintains the movable piston 52 in the second position.

The inner cylindrical sidewall 58 of the moveable piston 52 has a conical shape that corresponds to the conical shape of the conical mounting element 32 extending from the base surface 30 of the cavity 14.

Figure 4:
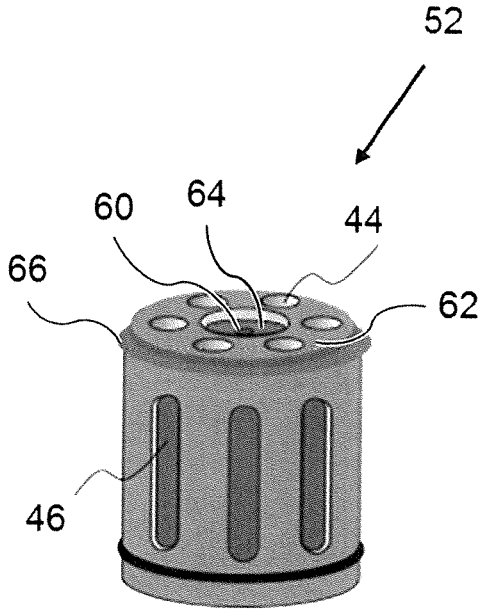
FIG. 4 shows embodiments of elongate temperature sensors.

In FIG. 4, a detailed perspective view of the movable piston 52 is depicted. The movable piston 52 is of cylindrical shape. In the proximal end face 62 (this is the upper end face in the view of FIG. 4) of the movable piston 52 a central opening 60 is provided. This central opening 60 is used for guiding the temperature sensor 40 during the axial movement of the piston 52. In addition to thereto additional openings 44, 46 are provided in the movable piston 52. These additional openings are used for establishing an airflow path from the cavity to and through the aerosol-generating article.

At the rim of the central opening 60, membranes 64 of polymeric material are provided. Similar membranes 66 are also provided at the outer circumferential portion of the upper end face 62 of the moveable piston 52. Upon movement of the piston along the longitudinal axis of the cavity, the membranes 64, 66 scrape against the thermal sensor and the inner side wall of the cavity and clean off any debris or contamination adhering thereto. Thus, the membranes 64, 66 constitute a wiping element and ensure that the inner surface of the cavity 14 and in particular the temperature sensor 40 are prevented from contamination.

Figure 5:
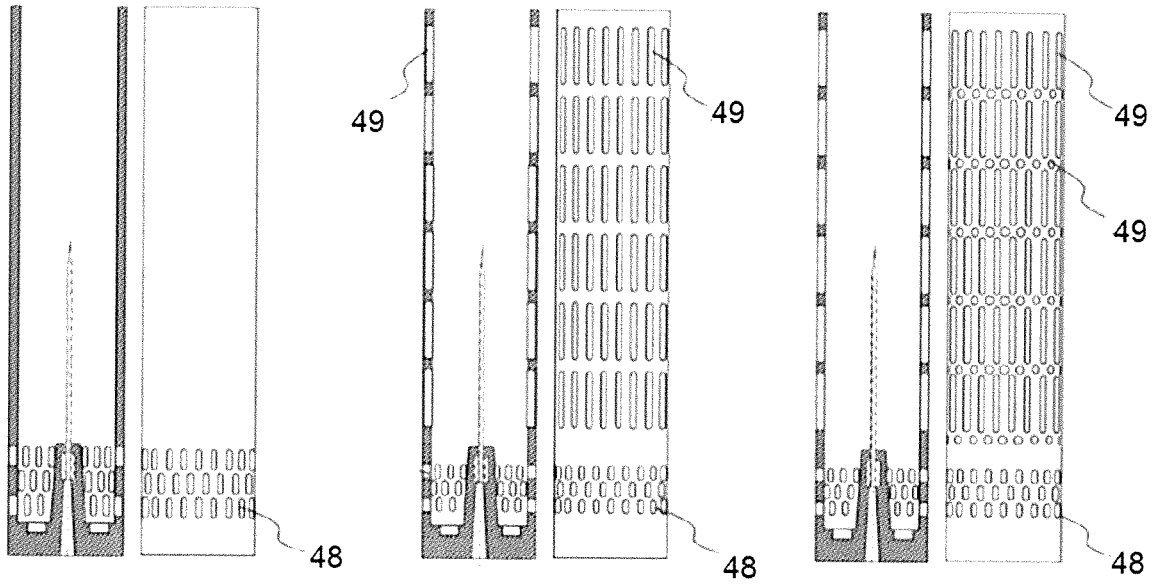
FIG. 5 shows a detailed view of a moveable piston.

In FIG. 5 various embodiments of a tubular susceptor element are depicted. All of these tubular susceptor elements are of general cylindrical shape and differ only in the configuration of the airflow openings 48 provided therein. In the configuration depicted in the left view of FIG. 5 airflow openings 48 are only provided in the vicinity of the base surface 30 of the cavity 14. In this configuration, ambient air that is drawn into the device via air inlets in the housing 12 may enter the cavity 14 through the airflow openings 48. This ambient air is guided through the distal end and of the aerosol-generating article and may be inhaled by a user drawing at the mouthpiece end of the aerosol-generating article.

The additional embodiments depicted in the further views of FIG. 5 comprise additional airflow openings 49 along the length of the tubular susceptor element. In particular, if the aerosol-generating articles used with correspondingly configured aerosol-generating devices 10, additional airflow routes through the aerosol-generating article may be established.

Figure 6:
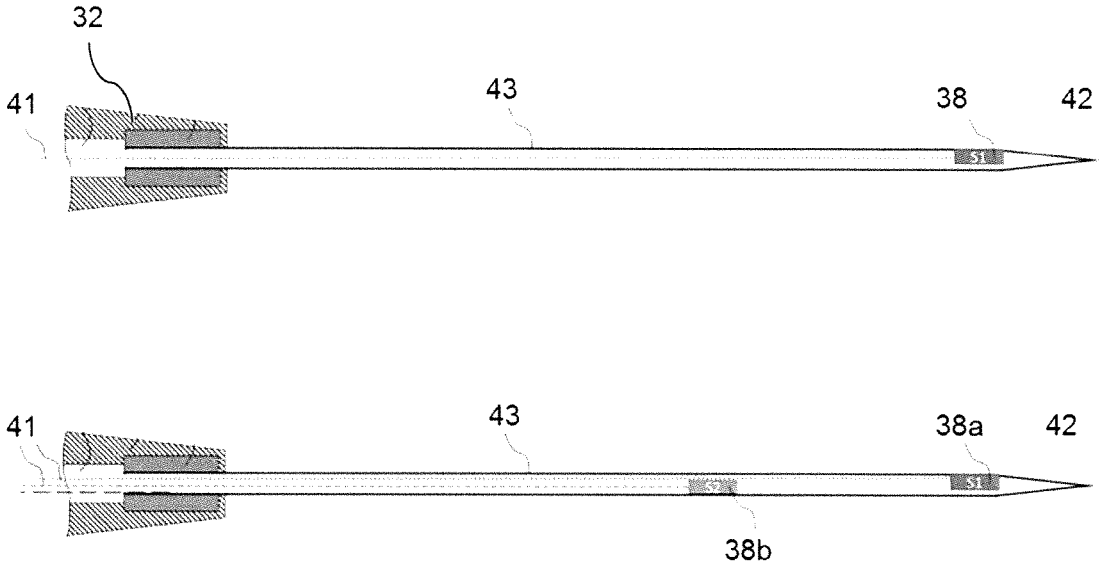
FIG. 6 shows a detailed view of a susceptor element.

FIG. 6 shows various embodiments of an elongate temperature sensor 40 to be used in an aerosol-generating device 10 of the present invention. In the upper view depicted in FIG. 6 an optical fibre microprobe comprising a single sensing point 38 is depicted. The optical fibre microprobe has a needle-shaped form and comprises an optical fibre 41 that is provided with a Polytetrafluoroethylene (PTFE) coating 43. The diameter of the optical fibre microprobe is about 1 millimetre. One end of the optical fibre microprobe is fixed to the conical mounting element 32. The free end 42 of the optical fibre microprobe is provided with a sensing point 38 that comprises a gallium arsenide (GaAs) crystal.

In the lower view depicted in FIG. 6 an optical fibre microprobe comprising two sensing points 38*a*, 38*b* is depicted. Each sensing point 381, 38*b* comprises a sensitive GaAs crystal and is connected to an optical fibre 41. By using two or even more optical sensing points 38 more detailed information on the actual temperature regime within the aerosol-forming substrate may be achieved.

The invention claimed is:

1. An aerosol-generating device, comprising:

a cavity configured to receive an aerosol-forming substrate;

an external heating element of the aerosol-generating device configured to exclusively externally heat the aerosol-forming substrate when the aerosol-forming substrate is received in the cavity, wherein exclusively externally heat relates to application of heat solely from a position external to the aerosol-forming substrate;

an elongate temperature sensor provided in the cavity and being configured to penetrate the aerosol-forming substrate when the aerosol-forming substrate is received in the cavity; and a protection mechanism configured to protect the elongate temperature sensor in the cavity, wherein the protection mechanism comprises a moveable piston that is arranged inside the cavity between cavity walls and the elongate temperature sensor.

2. The aerosol-generating device according to claim 1, wherein the elongate temperature sensor comprises a thermal sensing point.

3. The aerosol-generating device according to claim 2, wherein the thermal sensing point is a thermocouple or an optical fiber microprobe.

4. The aerosol-generating device according to claim 1, wherein the elongate temperature sensor comprises one or more thermal sensing points disposed at different positions along a length of the elongate temperature sensor.

5. The aerosol-generating device according to claim 1, wherein the elongate temperature sensor is tubular, solid, or partially solid.

6. The aerosol-generating device according to claim 1, wherein the external heating element at least partially defines the cavity.

7. The aerosol-generating device according to claim 1, wherein the external heating element is an inductive heating element comprising an induction coil and a susceptor arrangement.

8. The aerosol-generating device according to claim 7, wherein the inductive heating element further comprises a plurality of induction coils.

9. The aerosol-generating device according to claim 7, wherein the induction coil is disposed radially outward from the susceptor arrangement.

10. The aerosol-generating device according to claim 1, wherein a compression spring is provided, which is configured to bias the moveable piston in a position in which the moveable piston at least partly covers the elongate temperature sensor, when no aerosol-forming substrate is inserted into the cavity.

11. The aerosol-generating device according to claim 1, wherein the moveable piston is provided with a central opening through which the elongate temperature sensor extends.

12. The aerosol-generating device according to claim 11, wherein the central opening is provided with a wiping element configured to clean off any debris sticking to the elongate temperature sensor when the moveable piston is moved in the cavity.

13. An aerosol-generating system, comprising:

an aerosol-generating device according to claim 1; and an aerosol-generating article inserted into the cavity of the aerosol-generating device.

* * * * *